US005207534A

United States Patent [19]

Brasted et al.

[11] Patent Number: 5,207,534

[45] Date of Patent: May 4, 1993

[54] METHOD FOR CONDUCTING OFFSHORE WELL OPERATIONS

[75] Inventors: Lee K. Brasted, Kingwood; David A. Huete, Spring; George Rodenbush, Houston, all of Tex.

[73] Assignee: Shell Oil Company, Houston, Tex.

[21] Appl. No.: 918,914

[22] Filed: Jul. 23, 1992

Related U.S. Application Data

[63] Continuation of Ser. No. 624,867, Dec. 10, 1990, abandoned.

[51] Int. Cl.[5] ..... E02D 5/34

[52] U.S. Cl. ..... 405/209; 405/203; 405/223.1; 405/224.2

[58] Field of Search ..... 405/223.1, 195.1, 201, 405/203, 204, 209, 220, 224, 224.2, 224.4

[56] References Cited

U.S. PATENT DOCUMENTS

| | | | |
|---|---|---|---|
| 3,504,740 | 4/1970 | Manning . | |
| 3,717,002 | 2/1973 | O'Brien et al. . | |
| 3,727,414 | 4/1973 | Davies . | |
| 4,156,577 | 5/1979 | McMakin | 405/196 |
| 4,492,270 | 1/1985 | Horton | 166/358 |
| 4,633,953 | 1/1987 | LeBoeuf et al. | 166/358 |
| 4,643,614 | 2/1987 | Laursen | 405/195 X |
| 4,721,412 | 1/1988 | King et al. | 405/195 |
| 4,735,526 | 4/1988 | Kawagoe et al. | 405/203 X |
| 4,740,109 | 4/1988 | Horton . | |
| 4,754,817 | 7/1988 | Goldsmith . | |
| 4,784,529 | 11/1988 | Hunter . | |
| 4,893,965 | 1/1990 | Jordan | 405/195 X |
| 4,907,657 | 3/1990 | Cox | 405/195 X |
| 4,907,912 | 3/1990 | Smith | 405/208 |
| 4,913,238 | 4/1990 | Danazcko et al. | 166/350 |
| 4,934,871 | 6/1990 | Kazokas, Jr. . | |
| 4,966,495 | 10/1990 | Goldman | 405/195 |
| 4,972,907 | 11/1990 | Sellars, Jr. . | |
| 4,973,198 | 11/1990 | Cox | 405/195 X |
| 4,995,762 | 2/1991 | Goldman | 405/195 |

FOREIGN PATENT DOCUMENTS

WO85/01927 5/1985 World Int. Prop. O. .

OTHER PUBLICATIONS

"Conoco Readies Jolliet TLWP for Nov. 1 Startup", Ocean Industry pp. 17–21, Oct. 1989.

"Field Experience Proves Semisubmersible Drilling Tender Concept", by H. I. Knecht and M. E. Nagel, Offshore, Sep. 1990, pp. 56–57.

"Minifloater: A Deepwater Production Alternative", Kerckhoff et al., Ocean Industry, Sep. 1990, pp. 147–152.

"Semisubmersible Drilling Tender Unit" by James E. Chitwood and Alan C. McClure, SPE Drilling Engineering, Jun. 1987.

*Primary Examiner*—Dennis L. Taylor
*Assistant Examiner*—J. Russell McBee
*Attorney, Agent, or Firm*—Mark A. Smith

[57] ABSTRACT

A method is disclosed for conducting offshore well operations from an auxiliary vessel in support of a compliant platform. The auxiliary offshore drilling vessel is restrained with respect to the compliant platform in position adjacent the well bay of the compliant platform and vertically aligned with a selected well site for conducting well operations.

44 Claims, 7 Drawing Sheets

FIG. 2
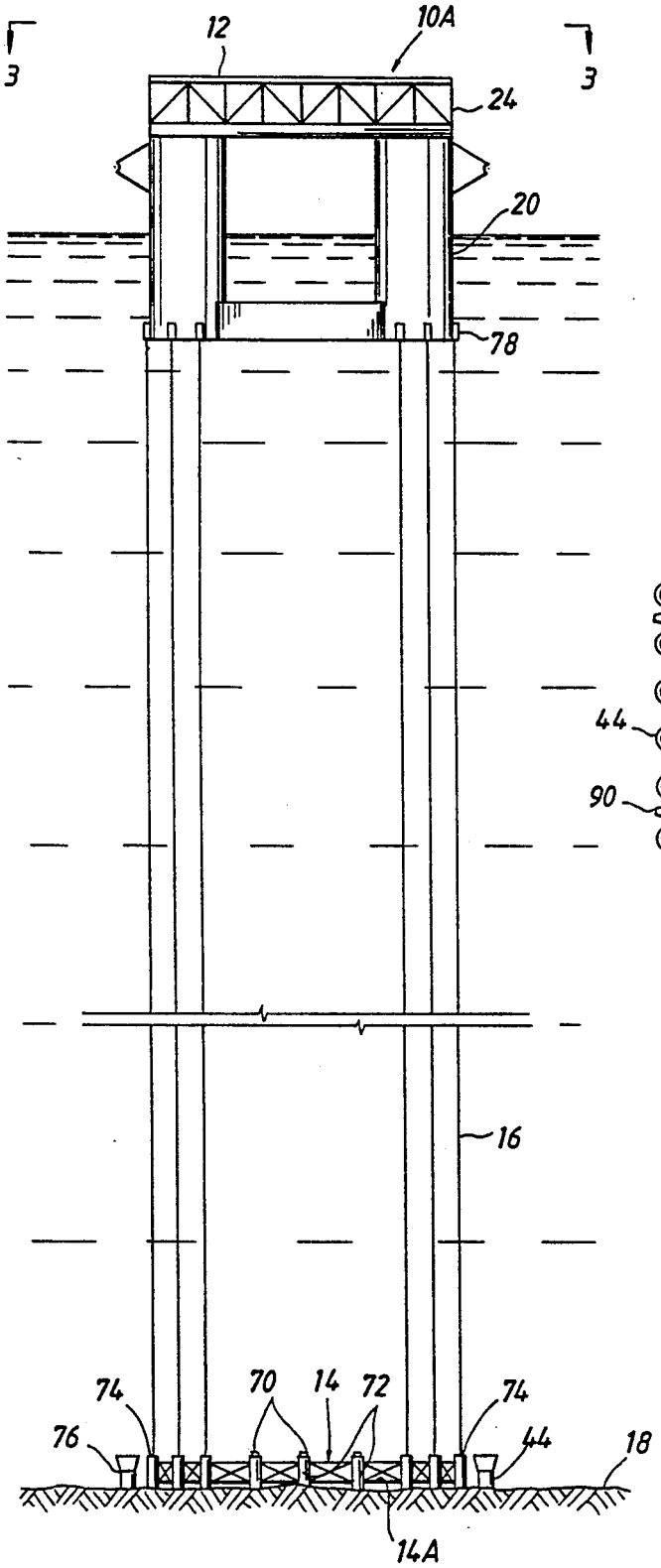
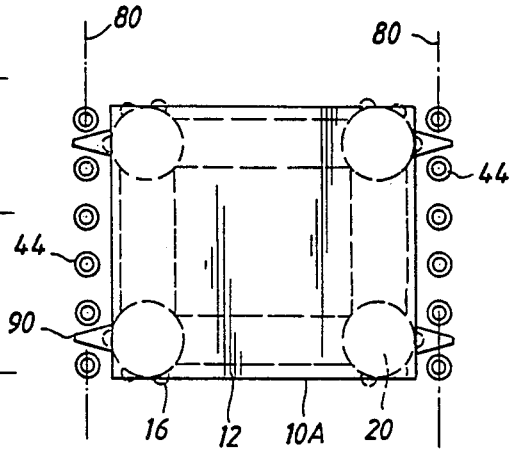
FIG. 3

52
40A
96
90A
10A
90
60
98
60
52

80
52
80
40A
96
90A
10A
90
60
60
98
90B
40
10
90
52

6B 6B
42
40A
48
10
40
118
28

40A
80
10
42
40
49
48

METHOD FOR CONDUCTING OFFSHORE WELL OPERATIONS

This is a continuation of application Ser. No. 624,867, filed Dec. 10, 1990, now abandoned.

BACKGROUND OF THE INVENTION

The present invention relates to a method for conducting well operations for offshore reservoirs. More particularly, the present invention relates to a method for supporting well operations for a compliant platform from an auxiliary vessel.

Traditional bottom-founded platforms having a fixed or rigid tower structures have been taken to their logical depth limits in the development of offshore oil and gas reserves. Economic considerations suggest that alternatives to this traditional technology be used in deep waters.

One alternative to fixed towers is to drill from facilities provided on surface vessels and to complete the wells at the ocean floor with subsea completions. Gathering lines connect the subsea wells to facilities usually located at the surface, either in the immediate vicinity or provided remotely in a satellite operation. However, subsea wells are relatively inaccessible at the ocean floor and this fundamental problem is exacerbated by the rigors of the maintenance-intensive subsea environment. The result is complex, costly maintenance operations.

Deepwater wells can be provided with surface completions on specialized structures more suitable for deepwater applications. Designs have been developed for various configurations of tension leg, compliant tower, and articulated tower platforms as well as floating production systems which can provide drilling and production facilities in deepwater at costs less than traditional fixed platforms. However, the cost of deepwater platforms increases with the extent of the drilling operations that are to be conducted from the platform. This substantially increases the load on the platform for full drilling capabilities, thereby requiring a substantially larger structure. Further, primary drilling operations to develop a dispersed reservoir with extended reach techniques from a central location can spread the drilling operations over many years. Subsequent well workover operations may tie the drilling rig to the platform many years thereafter even though primary drilling is complete. Both aspects represent economic inefficiencies. In the first instance, drilling such extended reach wells, one well at a time, delays production, thereby adversely affecting the rate of return of the substantial capital expenditures necessary to provide such a deepwater structure. Further, after the wells have been drilled, the rig represents a very substantial asset which cannot otherwise be efficiently used and has similarly permanently committed the prospect to the larger structure, thereby affecting the cost of the platform as well.

Alternatively, the wells can be predrilled from a drill ship or other floating facility, killed or otherwise secured, and completed from a scaled-down "completion" rig carried on a production platform such as a tension leg well platform ("TLWP") installed at the site later. This reduces the load on the permanent facilities and therefore permits a smaller platform, but prevents production from any well until all the wells have been drilled and thereby substantially defers revenue from the development. Further, this scheme does not allow the flexibility to permit additional or replacement drilling once the platform has been installed.

Efficient development of deepwater hydrocarbon reserves must overcome these deficiencies and provide a method for conducting well operations which facilitates lower capital outlays, faster return on investment, more efficient reservoir management for larger reservoirs, and enhanced profitability for reservoirs that are otherwise marginal.

SUMMARY OF THE INVENTION

It is an object of the present invention to provide a method of conducting well operations which facilitates the use of minimal compliant platforms in the development of offshore oil and gas wells, especially in deep water.

It is a further object of the present invention to provide a method for drilling oil and gas wells in deepwater in a manner affording surface completion without dedicated drilling facilities which will often sit idle during the production phase of the development.

Finally, it is an object of the present invention to provide a method for drilling additional development wells and to conduct maintenance work on existing wells supported on a compliant platform using facilities on an auxiliary vessel.

Toward the fulfillment of these and other objects, a method for conducting well operations for offshore wells supported by a compliant platform is provided which comprises restraining an offshore drilling vessel with respect to the compliant platform, aligning a drilling derrick of the offshore drilling vessel in substantially vertical alignment with a well bay of the compliant platform above the ocean surface and with a selected well site on the ocean floor, and conducting well operations through a substantially vertical riser.

Thus, the method and system of the present invention facilitates well operations support with an auxiliary vessel for surface accessible completions hung on a deepwater compliant platform. This permits the use of a compliant platform which does not have to be scaled to accommodate the weight of a major drilling rig and permits well operation facilities supplied by the auxiliary vessel to relocate when those facilities are not needed at the platform.

BRIEF DESCRIPTION OF THE DRAWINGS

The brief description above, as well as further objects, features and advantages of the present invention will be more fully appreciated by reference to the following detailed description of the preferred embodiments which should be read in conjunction with the accompanying drawings in which:

FIG. 2 is a side elevation view of a tension leg well jacket ("TLWJ") suitable for use in the practice of the present invention;

FIG. 3 is a top plan view of the TLWJ of FIG. 2 taken along line 3—3 of FIG. 2;

DETAILED DESCRIPTION OF PREFERRED EMBODIMENTS

Figure 1:
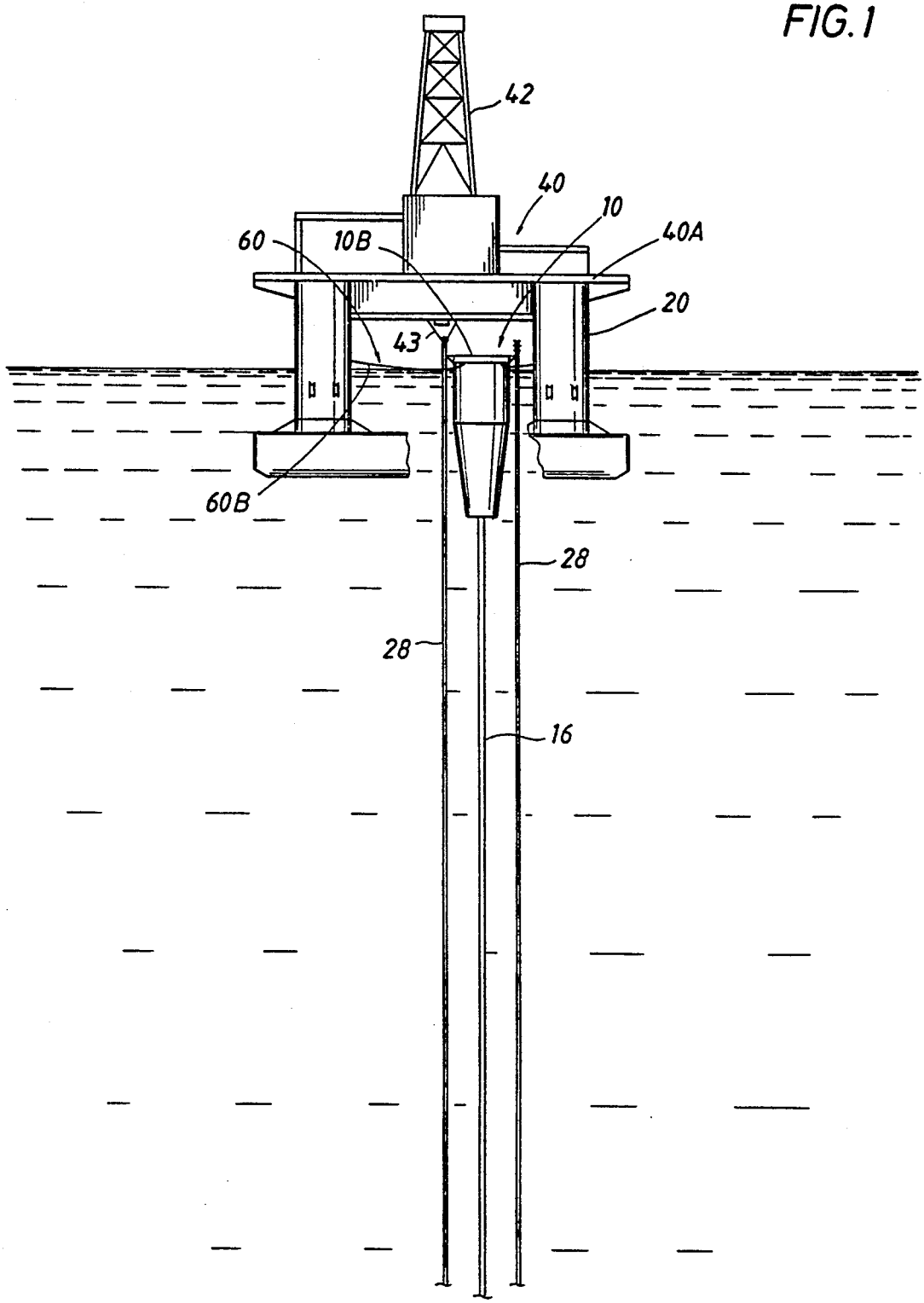
FIG. 1 is a side elevation view of a semisubmersible vessel conducting well operations in accordance with the present invention adjacent a monopod compliant platform.

FIG. 1 discloses an embodiment of the present invention in which a compliant platform 10 is a single column tension leg well jacket ("TLWJ") or "monopod" 10B installed to the ocean floor with one or more tendons 16 and an offshore drilling vessel 40 is a semisubmersible vessel 40A configured to straddle and ride over the installed monopod. The monopod is held in position with respect to the semisubmersible vessel by restraining system 60, here a set of guylines 60B. However, drilling operations are conducted substantially in place at the well slot through a drilling riser supported by the semisubmersible vessel with a tensioning system 43. After completion of drilling operations, the drilling riser is replaced with a production riser 28 which, in the preferred practice, is secured to the monopod before completion operations. A previously drilled and completed well is illustrated with another production riser 28 which is supported by monopod 10B. The monopod structure could alternatively be any compliant platform structure small enough to be bounded by the semisubmersible vessel's lower hull components.

Figure 4:
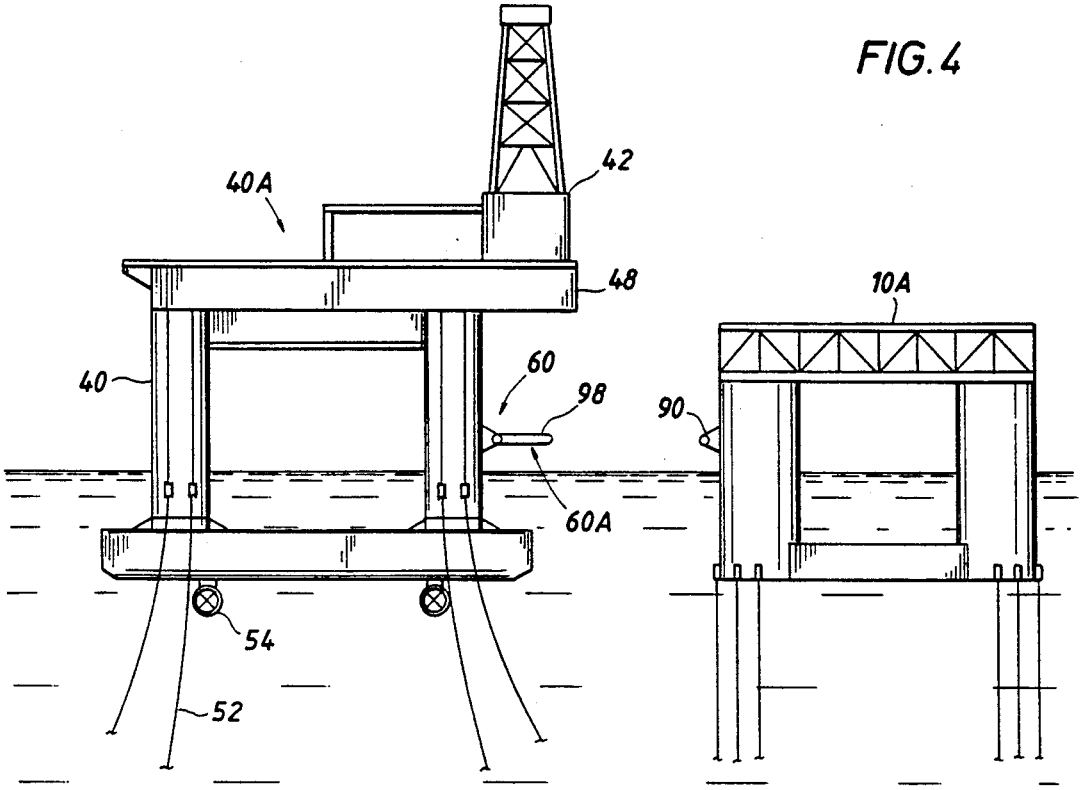
FIG. 4 is a side elevation view of a semisubmersible vessel approaching a compliant platform in accordance with the present invention.
Figure 6C:
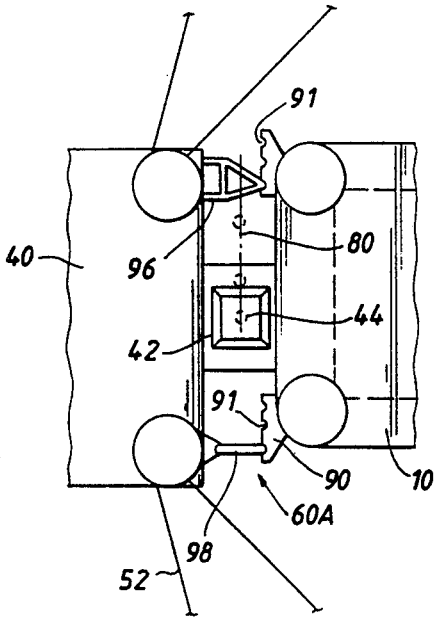
FIG. 6C is an overhead view of an alternative means for docking the offshore drilling vessel and the compliant platform.
Figure 5:
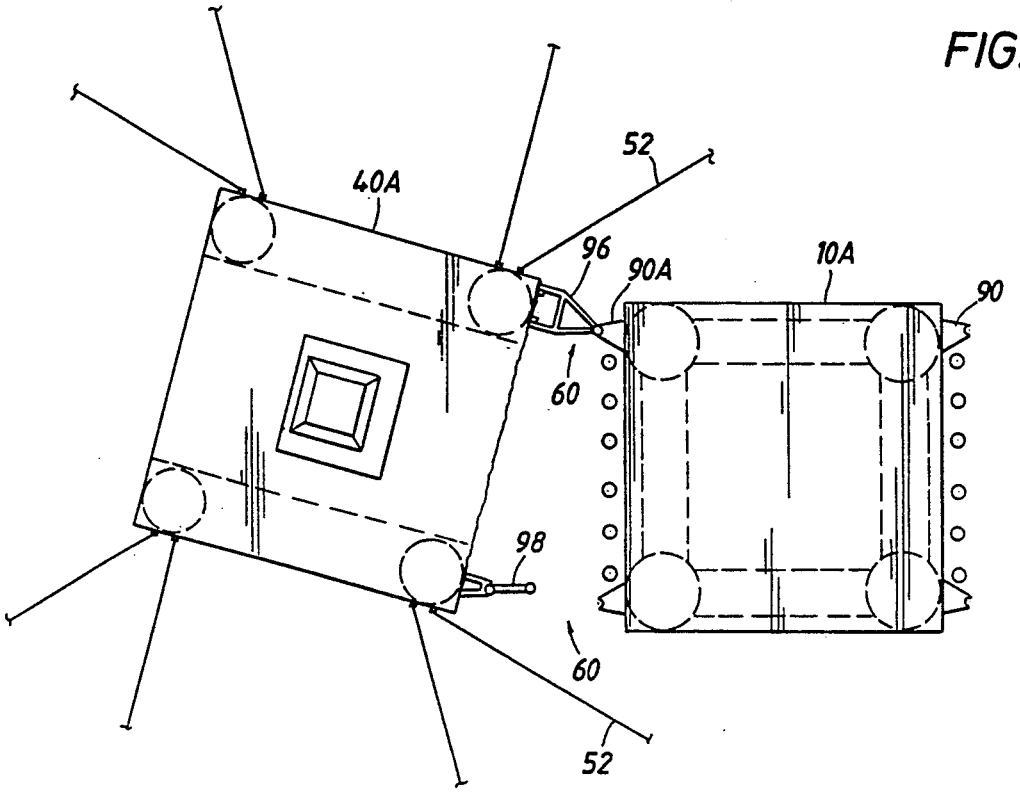
FIG. 5 is a partially broken away overhead view of a semisubmersible vessel beginning docking operations with a compliant platform in accordance with an embodiment of the practice of the present invention.
Figure 6:
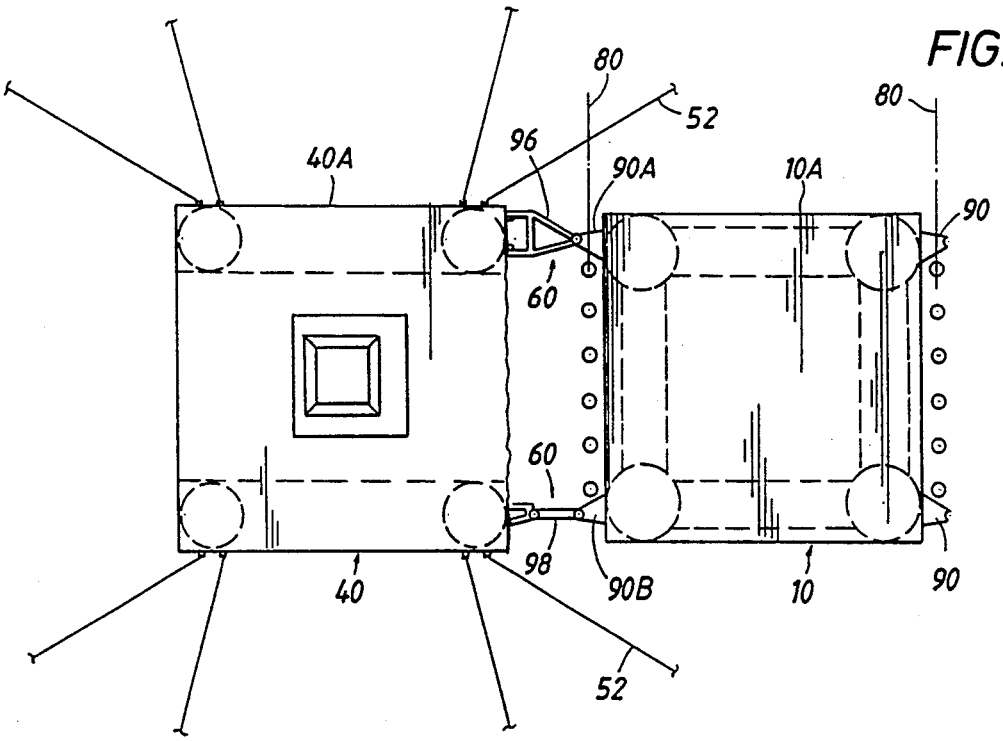
FIG. 6 is a partially broken away sectional overhead view of a semisubmersible vessel completing docking operations with a compliant platform in accordance with the practice of an embodiment of the present invention.

The present invention provides well operations facilities to a compliant platform from an auxiliary vessel. A "compliant" platform is any offshore surface facility designed to "give" in a controlled manner with environmental loading rather than rigidly resist such force. This basic design precept distinguishes the fixed or rigid bottom-founded towers which require vast amounts of structural materials for extension into deep water. Many basic configurations of compliant platforms have been proposed including articulated towers, compliant towers, compliant piled towers, TLP's, etc. However, any basic configuration which is compliant, favorably economically sensitive to load reductions, and adapted to receive operations support form an offshore vessel is well suited for use in the practice of the present invention. FIGS. 4 through 6 illustrate the practice of the present invention using the tension leg well jacket ("TLWJ") of FIGS. 2 and 3, but those skilled in the art and familiar with the teachings of this application could apply this practice to any other basic compliant platform configuration.

FIGS. 2 and 3 illustrate a TLP configuration which is especially suited for the practice of the method of the present invention. This compliant platform is a tension leg well jacket ("TLWJ") 10A which comprises a minimal TLP without drilling capabilities, and, at most, modest workover capabilities. The TLWJ is designed to exteriorly receive and secure production risers passed from the offshore drilling vessel (not shown here). FIG. 2 is a side elevation view of the TLWJ and FIG. 3 is an overhead view.

Installation of TLWJ 10A begins by placing function 14, here supplied by unitary template 14A. The foundation is then secured to ocean floor 18. In the illustration, a plurality of piles 70 are driven into the ocean floor through pile sleeves 72 of the foundation and the piles are then secured to the pile sleeves with grouping or swaging operations. Other well known means for anchoring the foundation to the ocean floor may also be suitable. The foundation provides a means 74 for connecting tendons 16 and may include well guides 76 which are placed at well sites 44 adjacent the foundation. In the illustration, the well guides are placed independently and are not connected to the template. In some instances it is desirable to predrill some of the wells.

Superstructure 12 comprising buoyant hull 20 and deck 24 is towed to location and ballasted down. Tendons 16 are installed between means 74 for connecting the tendons to the foundation and means 78 for connecting the tendons 16 to floating superstructure 12. The tendons are initially tensioned during installation and deballasting of buoyant hull 20 further tensions the tendons to provide additional excess buoyancy to the TLWJ as necessary to produce the desired behavior under all loading conditions.

Desired well sites 44 are aligned in well lines or pattern 80 adjacent TLWJ 10A as depicted in FIG. 3. Provisions are discussed below which facilitate laterally receiving and securing production risers transferred from an offshore drilling vessel. Another feature of the illustrated TLWJ is a plurality of docking supports 90, the purpose and function of which will become apparent in the discussion of the docking procedures illustrated in FIGS. 5 and 6.

FIG. 4 illustrates deployment of offshore drilling vessel 40 adjacent installed TLWJ 10A. The offshore drilling vessel is a floating structure which carries a derrick, drawworks and related drilling facilities 42. Further, the term "offshore drilling vessel" is intended to cover any transportable, floating facilities of an auxiliary vessel capable of supporting well operations such as drilling, completion, workover, well repair or abandonment which is compatible with the compliant platform design. Preferably these facilities are provided in an open design adapted for stability in deepwater drilling applications. Two semisubmersible vessel configurations are particularly well suited to this application and have been used to generally illustrate the practice of the present invention; see the semisubmersible vessels of FIGS. 4 and 4A, respectively.

FIG. 4 illustrates a special purpose semisubmersible vessel having a cantilevered deck 48 with an end well bay providing a derrick and attendant drilling facilities thereon. In the preferred embodiment, the cantilevered deck allows well operations at the well bay of the compliant platform. Peripheral well bays are well suited to the present invention, but central well bays are serviceable with a compatible offshore drilling vessel.

Semisubmersible vessel 40A in FIG. 4 is maneuverable by either catenary mooring lines 52 or dynamic positioning thrusters 54. For purposes of this embodiment of the practice, the catenary mooring lines are deployed and anchored in a spread about the semisubmersible vessel which overlaps the position of the TLWJ. Semisubmersible vessel 40A can then be maneuvered to present the end bay adjacent TLWJ 10A by playing out and retrieving selected catenary mooring lines 52.

Figure 4A:
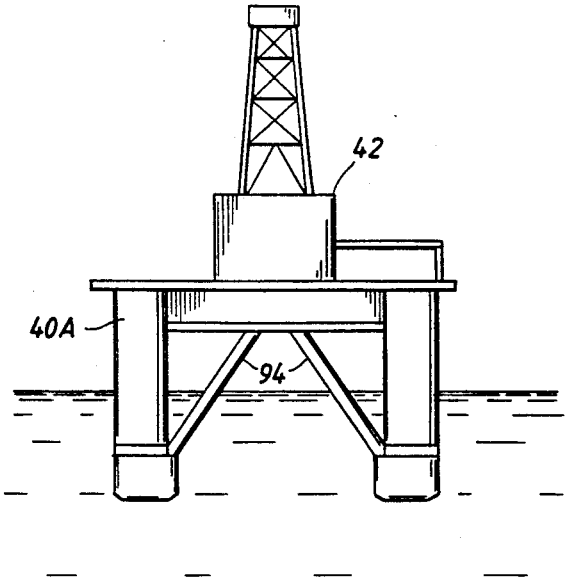
FIG. 4A is a front elevation view of a semisubmersible vessel.

FIG. 4A illustrates adaptation of a conventional center bay semisubmersible vessel suitable for practice of the present invention in the embodiment of FIG. 1. This Figure shows the end of semisubmersible vessel 40A which will straddle the monopod or other TLWJ. Certain conventional semisubmersible vessel configuration can be "opened up" to provide lateral access from beneath the semisubmersible vessel by removing a horizontal brace conventionally placed between the pontoons and reinforcing the remaining structure, such as with diagonal struts 94. If desired, provisions may be undertaken to allow the horizontal brace to be selectively removed for passage of the TLWJ, yet provide stability in place during transport and, perhaps, during drilling operations.

Returning to FIG. 4, another modification of conventional semisubmersible vessel necessary to best facilitate the practice of the invention is installation of a restraining system 60, which in this embodiment is provided by a means 60A for docking which comprises a hinged docking frame 96 and a hinged docking strut 98. See FIGS. 5 and 6.

FIG. 5 illustrates the initiation of docking procedures between semisubmersible vessel 40A and TLWJ 10A. Both FIGS. 5 and 6 have been illustrated with the cantilevered deck broken away in order to simplify the illustration. Catenary mooring lines 52 are adjusted to bring lowered docking frame member 96 adjacent docking support 90A on the TLWJ and a connection is made, e.g. by inserting a pin. The docking frame then secures the semisubmersible vessel to the TLWJ to produce a 2-degree of freedom restraint.

Catenary mooring lines are further adjusted to rotate the semisubmersible vessel 40A and bring lowered docking strut 98 into position to connect with docking support 90B. See FIG. 6. Similarly, this connection can be secured with a pin or a multi-axis rotation connection and will provide a 1-degree of freedom restraint. This fully secures the offshore drilling vessel 40 to complaint platform 10 such that wave action will not cause collisions between the two.

In accordance with the present invention, the offshore drilling vessel is restrained with respect to the compliant platform at a position presenting drilling facilities 42 in substantial alignment with the well bay of the complaint platform. This alignment also substantially vertically aligns the drilling facilities with the well pattern on the ocean floor while the compliant platform remains in its normal position aligned with the well pattern.

Figure 6A:
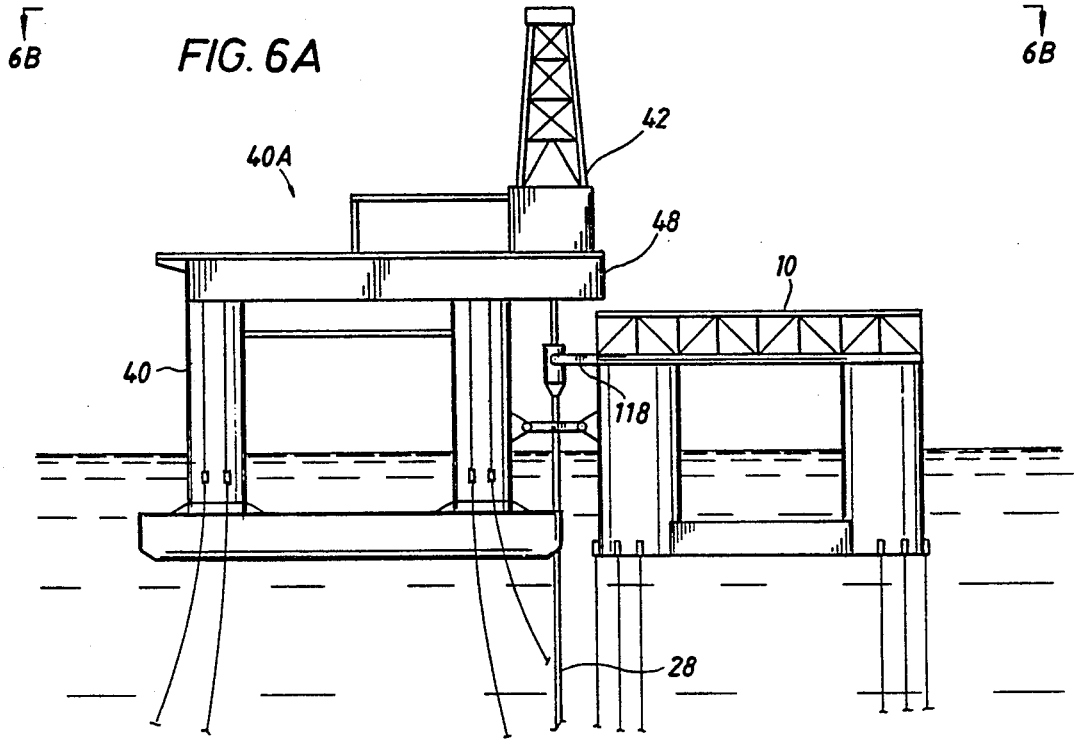
FIG. 6A is a side elevation view of a semisubmersible vessel docked to a compliant platform in position for conducting well operations for a selected well site in accordance with the practice of an embodiment of the present invention.
Figure 6B:
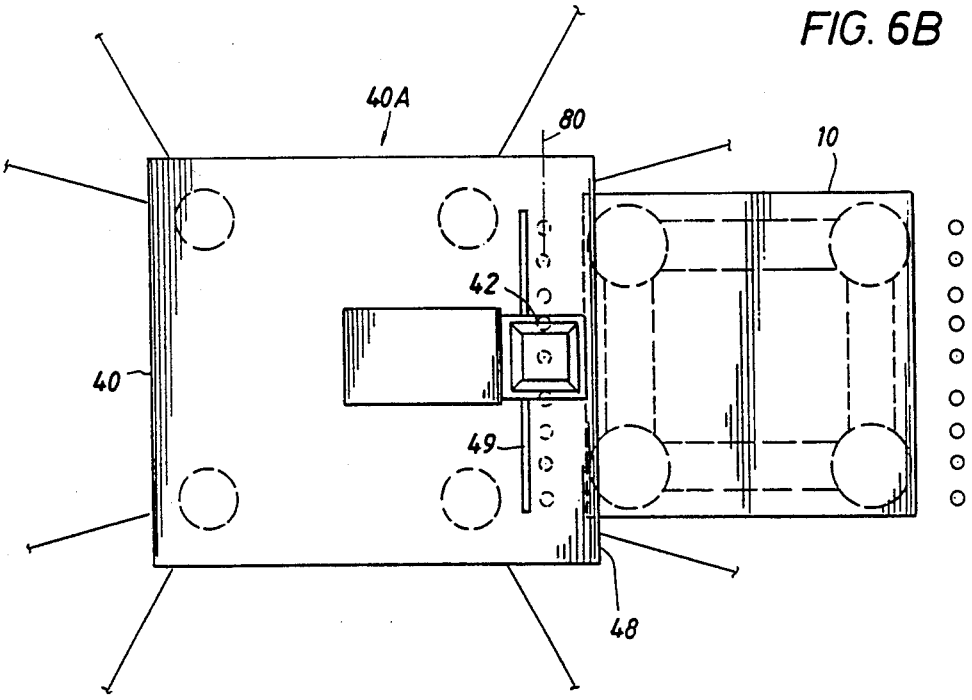
FIG. 6B is a top plan view of the semisubmersible vessel docked with a compliant platform and conducting well operations in accordance with the practice of an embodiment of the present invention.

FIGS. 6A and 6B illustrate semisubmersible vessel 40 A conducting well operations for compliant platform 10 from drilling facilities 42 mounted on cantilevered deck 48. The well operations are conducted through a riser 28 secured in a well slot of the well bay of the compliant platform. While it may be desired to support heavier drilling risers with the offshore drilling vessel, a preferred embodiment for practicing the present invention supports lighter risers with the compliant platform during well operations. Compare FIG. 6A with riser 28 secured to riser support 118 with FIG. 1 in which riser support is provided by offshore drilling vessel 40 in position at the well bay of the compliant platform. In either case, this proximity of auxiliary drilling facilities to compliant platform well bay simplifies riser handling operations for transfer of the riser tension from offshore drilling vessel 40.

Supporting the riser during drilling operations from the compliant platform also facilitates a rapid mobilization of the offshore drilling vessel if the threat of a major storm becomes imminent. Thus, the drill string is tripped, the restraining system between the compliant platform and the offshore drilling vessel is released, and the offshore drilling vessel is withdrawn, moved off and secured for hurricane conditions a safe distance away while the riser remains secured to the compliant platform. Further, the benefits of supporting the riser during well operations may be extended to heavier risers, e.g., for primary drilling, by providing the riser with buoyancy modules.

Various systems can be employed to shift well operations from one well site to the next within the well pattern. For example, well sites on one side of TLWJ 10A in FIG. 6B can be reached successively by skidding derrick 42 on skid beams 49 across cantilevered deck 48. Ballast within semisubmersible vessel 40A is shifted to compensate for redistribution of load on the deck of the offshore drilling vessel.

Alternatively, the restraining system may be designed to accommodate relative movement between the whole offshore drilling vessel and the compliant platform. Thus, mooring lines 60B of FIG. 1 may be adjusted with the repositioning of offshore drilling vessel 40. Similarly, docking means 60A of FIG. 6C similarly facilitates relative movement between the offshore drilling vessel 140 and compliant platform 10. In this embodiment, docking supports 90 provide multiple sockets 91 for receiving docking elements 96 and 98. The docking elements are released and the offshore drilling vessel 40 repositioned in the next pair of sockets 91 for conducting well operations at another selected well site 44 along well pattern 80.

Thus, the method of the present invention facilitates well operations in support of compliant platform. More particularly, it provides a method for primary drilling, infill drilling, completion of predrilled wells, workover operations and any other major well operations which, in the prior art, would have required considerable, dedicated facilities to be provided on the compliant platform. The benefits of the present method for conducting well operations are best understood in relation to full deployment of the compliant platform in the development of offshore hydrocarbon reserves. Thus, a discussion of FIGS. 7-11 will help those having ordinary skill in the art to best appreciated the benefits of the present invention.

Figure 7:
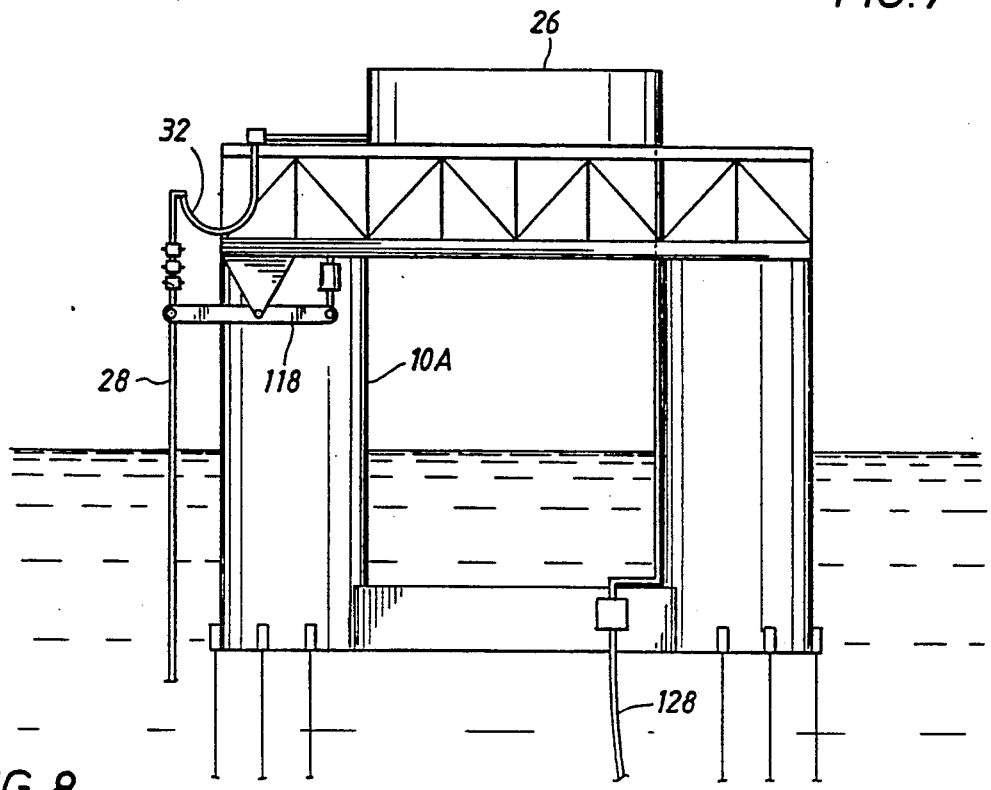
FIG. 7 is a side elevation view of a tension leg well jacket in the production mode.

FIG. 7 illustrates TLWJ 10A in the production mode in which a plurality of production risers 28 are supported by TLWJ 10A through a dynamic tensioning device 118. Fluids produced from the well are carried up the production riser and to facilities 26 through flexible flowlines 32 for combination and/or treatment before export through a catenary export riser 128 to transport facilities such as a subsea pipeline (not shown).

The dynamic tensioning device serves to maintaining a substantially constant tension on production riser 28 despite motion of compliant platform 10 due to environmental forces. Many types of dynamic tensioning devices are suitable, including pneumatic, hydraulic, elastomeric, or combinations thereof. In some instances, such as where the risers are approximately the same length as the tendons, dynamic tensioning devices may not be necessary.

Communication is established between the surface Christmas tree 30 which is affixed atop the production riser 28 with a flexible flowline 32. Flowline 32 feeds the production fluids from production riser 28 to processing facilities 26. The processing facilities may be as simple a manifolds collecting the production fluids from a number of wells and directing them to an export riser, or may include separation equipment for removing liquid products from gas produced or other various treatment systems to initially process the produced fluids into components more suitable for transport.

Figure 8:
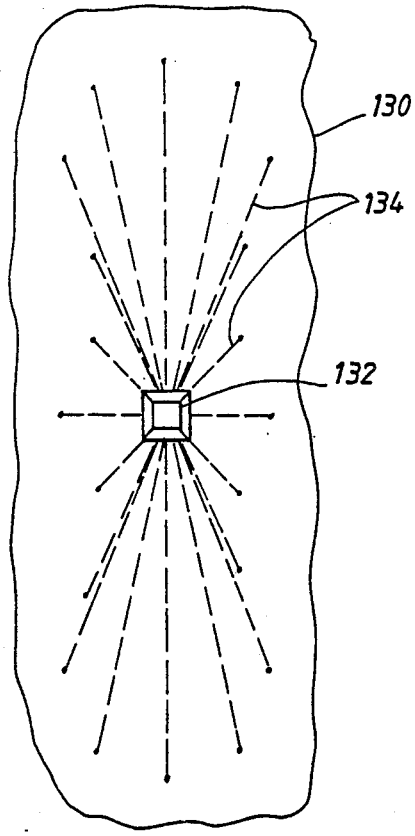
FIG. 8 (PRIOR ART)
FIG. 8 is an overhead view schematically illustrating the use in the prior art of central facilities to develop extended deepwater reservoirs.
Figure 9:
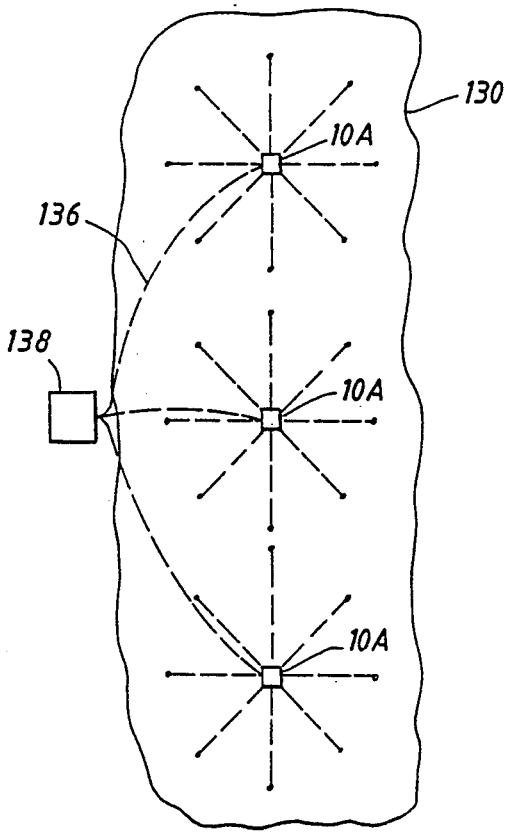
FIG. 9 is an overhead view schematically illustrating the use of satellite TLWJ's as facilitated by the present invention.

FIGS. 8 and 9 demonstrate some of the potential advantages of practicing the present invention. FIG. 8 is a schematic diagram of a deepwater reservoir 130 developed conventionally such as through a central TLP 132. The extended reach drilling operations from the TLP must project horizontally a great distance in order to reach the far portions of the reservoir. The completed wells are designated by broken lines 134. These wells are drilled, one well at a time, over a number of years in order to establish the pattern illustrated. Production from later wells must be deferred until they can be reached. Further, the great horizontal reach defers completion of each well while, in effect, a lengthy underground pipeline is built for each well as the wellbore is cased and drilling proceeds. The large TLP structure necessary to support the drilling operations requires a very promising field and a great number of wells to prove economically attractive and, once completed, supports an idle drilling rig substantially through the remaining life of the field.

By contrast, the same deepwater reservoir 130 is illustrated in FIG. 9 in which satellite TLWJs 10A combine with a tension leg production facility 138 to provide a more rapid, more thorough, and more economical development of reservoir 130. FIGS. 8 and 9 depict approximately the same number of total wells, at approximately the same location. However, in FIG. 9, satellite TLWJs 10A are used with less extensive extended reach drilling to efficiently collect production fluids and, with only the most minimal processing, transfer the produced hydrocarbons to processing facility 138 through pipelines 136. The TLP with production facilities 138 may itself support additional wells 134 drilled with external facilities. In this illustration, three separate semisubmersible vessels may simultaneously conduct well operations to substantially shorten the completion time. Further, this system will afford the opportunity to have revenue streams from those wells that have been completed while additional wells are being drilled. The minimal tension leg well jacket, and process facilities on a central TLP that does not have to support drilling equipment, can be installed at a lower cost than the central TLP of the prior art which accommodates drilling from the TLP. Further, after drilling is complete, the semisubmersible vessels may be put into useful service elsewhere until needed for workover operations. Thus, the method of conducting well operations of the present invention permits reduced capital outlay, accelerated cash flow, increased rate of return on investment, and avoids the capital expenses associated with providing a full capability drilling rig dedicated for workover operations.

Figure 10:
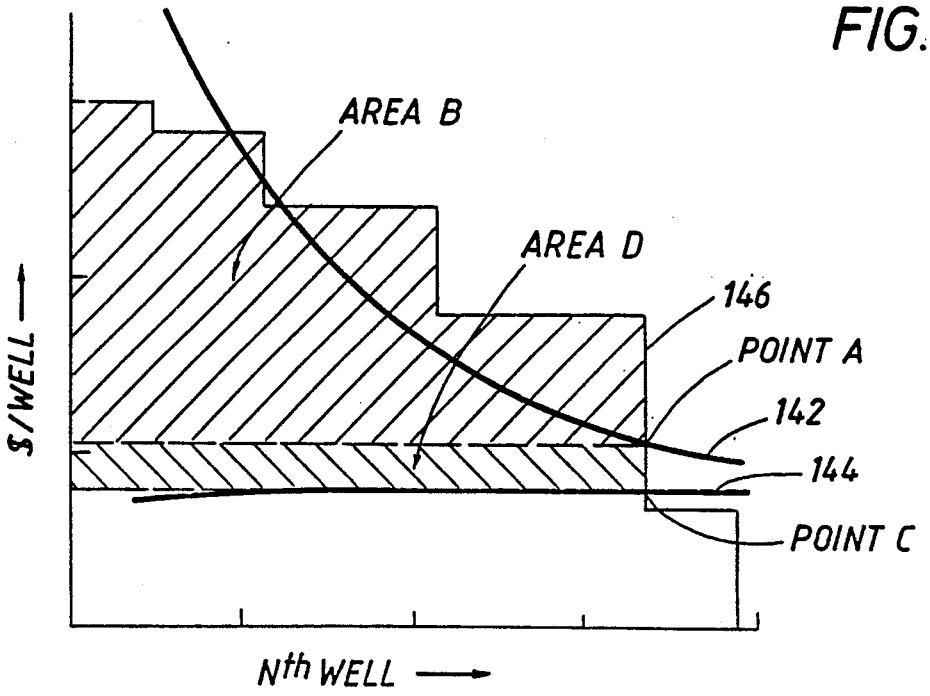
FIG. 10 is a generalized plot of economic curves of cost per well for each additional well for a hypothetical deepwater prospect "A"
Figure 11:
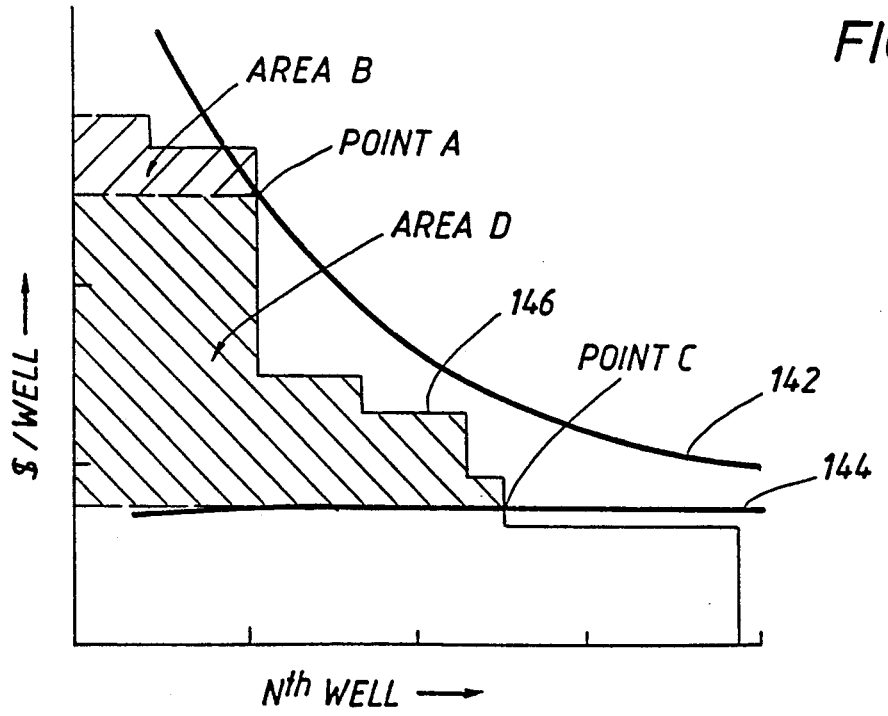
FIG. 11 is a generalized plot of economic curves of cost per well for each additional well for another hypothetical deepwater prospect, prospect "B".

FIGS. 10 and 11 further demonstrate the economic benefits which are facilitated by the practice of the present invention. FIG. 10 is a set of generalized curves for a hypothetical prospect "A". This illustration charts average development dollars per well for a conventional TLP development which includes a dedicated drilling rig (line 142) and a TLWJ development in accordance with the present invention (line 144) versus the number of wells "n" in the development. Also plotted is the present value income for the $n^{th}$ well which is expressed as line 146.

Present value income appears as a stair step function for which incremental contribution by additional wells decreases as the number of wells approaches the reservoir's capacity. Drilling completion costs per well are nationally included in the conventional TLP and the TLWJ development cost curves, but make little impact in the comparison since they are relatively constant regardless of whether a dedicated rig is provided on the TLP in accordance with the prior art or a semisubmersible vessel is used in the practice of the present invention.

Prospect A is a very promising prospect which can support a major, conventional, TLP deployment. The incremental development cost of the conventional TLP deployment, that is (line 142, intersects the line defining the present value income per well (line 146), at point A which produces a net present value profit designated by area B. Stated otherwise, the profit is the total income for all developed wells minus the total development cost which is the cost per well at the point of intersection times the number of developed wells.

By contrast, the incremental development cost of a TLWJ in the practice of the present invention intersects the present value income per well line 146 at point C and provides additional income opportunity indicated by area D, for a total present value income per well of B plus D.

While FIG. 10 does illustrate a definite advantage, the practice with less promising prospects such as prospect "B" illustrated in FIG. 11, illustrates more profound benefits available through the practice of the present invention. Again, these generalized economic curves plot development costs and income potential in terms of dollars per well as a function of the next incremental development well. The incremental development costs of a major, dedicated rig TLP remain the same, as do the incremental development costs for a tension leg well jacket deployed in the practice of the present invention. However, the nature of the prospect has markedly affected the available present value income per well. Here, the economic development of a TLP with dedicated drilling facilities is determined by point A, which defines little profitability B. However, the incremental cost of development for additional wells in deployment of a TLWJ in the practice of the present invention, as established by point C, defines a vast incremental benefit as the present value income of area D. Note that this benefit cannot be economically exploited by a major TLP with dedicated drilling facilities. Thus, for the same prospect, the conventional technology provides a present value income B while the present invention provides a present value income of B plus D which, for marginal prospects, can be many times that otherwise available. This also demonstrates that the practice of the present invention can render economical the development of prospects which cannot be economically developed by the prior art.

Not only does the well operations method of the present invention facilitate using multiple, dispersed, minimal compliant platforms for the benefits illustrated above, it also reduces the risk of accident, as well as the potential magnitude thereof, by separating drilling and production operations. Further, moving well operations facilities to an auxiliary vessel allows use of minimal compliant platforms to support the production risers and this reduced structure size will significantly expand the number of suitable fabrication yards that are available. This will further impact cost as a result of increased competition for the construction contracts.

A number of variations have been disclosed for the present method for conducting well operations for compliant platforms using temporary facilities of an offshore vessel. However, other modifications, changes and substitutions are intended in the foregoing disclosure. Further, in some instances, some features of the present invention will be employed without a corresponding use of other features described in these preferred embodiments. Accordingly, it is appropriate that the appended claims be construed broadly and in a manner consistent with the spirit and scope of the invention herein.

What is claimed is:

1. A method for conducting well operations in support of a compliant platform, comprising:

positioning a derrick on an offshore drilling vessel substantially over a surface well bay supported by the compliant platform which is in substantially vertical alignment with a well pattern on the ocean floor;

temporarily restraining the offshore drilling vessel with respect to the compliant platform; and conducting well operations from the offshore drilling vessel through a substantially vertical drilling riser while the offshore drilling vessel is temporarily restrained with respect to the compliant platform.

2. A method for conducting well operations in accordance with claim 1 wherein positioning the derrick of the offshore drilling vessel further comprises extending the drilling derrick from the offshore drilling vessel on a cantilevered deck.

3. A method for conducting well operations in support of a compliant platform in accordance with claim 1 wherein positioning the derrick of the offshore drilling vessel substantially over the well bay of a compliant platform comprises placing a central well bay semisubmersible vessel over a monopod configuration compliant platform.

4. A method for conducting well operations in accordance with claim 3 wherein restraining the offshore drilling vessel with respect to the compliant platform comprises securing the monopod with a plurality of guylines extending from the semisubmersible.

5. A method for conducting well operations in accordance with claim 2 wherein restraining the offshore drilling vessel with respect to the compliant platform further comprises docking a semisubmersible vessel to a TLWJ.

6. A method for conducting well operations in accordance with claim 1 wherein positioning a derrick of an offshore drilling vessel further comprises adjusting a plurality of catenary mooring lines which define the position of a semisubmersible vessel.

7. A method for conducting well operations in accordance with claim 1 wherein positioning the derrick of the offshore drilling vessel comprises positioning a semisubmersible vessel with a dynamic positioning system including a set of thrusters.

8. A method for conducting well operations in accordance with claim 1 wherein conducting well operations further comprises supporting the riser from the compliant platform during well operations.

9. A method for conducting well operations in accordance with claim 1 wherein conducting well operations further comprises supporting the riser from the offshore drilling vessel substantially within position in the surface well bay of the compliant platform during well operations.

10. A method for conducting well operations in accordance with claim 1 further comprising sequentially positioning the derrick over a plurality of selected well sites within the well pattern for conducting well operations at each selected well site.

11. A method for conducting well operations in accordance with claim 10 wherein sequentially positioning the derrick comprises adjusting the means for restraining the offshore drilling vessel with respect to the compliant platform to selectively shift the relative positions therebetween.

12. A method for conducting well operations in accordance with claim 11 wherein adjusting the means for restraining the offshore drilling vessel with respect to the compliant platform comprises adjusting a plurality of guylines between the semisubmersible vessel and the compliant platform.

13. A method for conducting well operations in accordance with claim 11 wherein adjusting the means for restraining the offshore drilling vessel with respect to the compliant platform comprises shifting the docking of the semisubmersible vessel to the compliant platform.

14. A method for conducting well operations in accordance with claim 10 wherein sequentially positioning the derrick further comprises skidding the derrick on skid beams.

15. A method for conducting offshore well operations, comprising:

positioning a derrick on an offshore drilling vessel in substantially vertical alignment with both a surface well bay supported by a compliant platform and a well pattern on the ocean floor;

restraining the offshore drilling vessel with respect to the compliant platform;

conducting well operations from the offshore drilling vessel through a riser; and disengaging the offshore drilling vessel from restrainment with regard to the compliant platform.

16. A method for conducting well operations in accordance with claim 15 wherein conducting well operations comprises completing a predrilled well through a production riser.

17. A method for conducting well operations in accordance with claim 15 wherein conducting well operations comprises conducting primary drilling of a new well.

18. A method for conducting well operations in accordance with claim 15 wherein conducting well operations comprises a secondary, infill drilling of a new well.

19. A method for conducting well operations in accordance with claim 15 wherein conducting well operations comprises conducting workover operations of an existing well.

20. A method for conducting well operations, comprising:

positioning a non-dedicated auxiliary offshore drilling vessel over a selected well site of a well pattern adjacent a compliant platform;

restraining the offshore drilling vessel with respect to the compliant platform which is maintained in its normal position in which a surface well bay is presented substantially over the well pattern; and conducting well operations through a substantially vertical riser using facilities on the offshore drilling vessel.

21. A method for conducting well operations in support of a compliant platform, comprising:

positioning a derrick on an offshore drilling vessel substantially over a surface well bay on the compliant platform in substantially vertical alignment with a well pattern on the ocean floor;

temporarily restraining the offshore drilling vessel with respect to the compliant platform;

conducting well operations from the offshore drilling vessel through a substantially vertical drilling riser; and disengaging the offshore drilling vessel from restrainment with the compliant platform.

22. A method for conducting well operations in accordance with claim 21 wherein positioning the derrick of the offshore drilling vessel further comprises extending the drilling derrick from the offshore drilling vessel on a cantilevered deck.

23. A method for conducting well operations in accordance with claim 22 wherein restraining the offshore drilling vessel with respect to the compliant platform further comprises docking a semisubmersible vessel to a TLWJ.

24. A method for conducting well operations in support of a compliant platform in accordance with claim 21 wherein positioning the derrick of the offshore drilling vessel substantially over the well bay of a compliant platform comprises placing a central well bay semisubmersible vessel over a monopod configuration compliant platform.

25. A method for conducting well operations in accordance with claim 24 wherein restraining the offshore drilling vessel with respect to the compliant platform comprises securing the monopod with a plurality of guylines extending from the semisubmersible vessel.

26. A method for conducting well operations in accordance with claim 21 wherein conducting well operations further comprises supporting the riser from the compliant platform during well operations.

27. A method for conducting well operations in accordance with claim 21 wherein conducting well operations further comprises supporting the riser from the offshore drilling vessel substantially within position in the surface well bay of the compliant platform during well operations.

28. A method for conducting well operations in accordance with claim 21 further comprising sequentially positioning the derrick over a plurality of selected well sites within the well pattern for conducting well operations at each selected well site.

29. A method for conducting well operations in accordance with claim 28 wherein sequentially positioning the derrick comprises adjusting the means for restraining the offshore drilling vessel with respect to the compliant platform to selectively shift the relative positions therebetween.

30. A method for conducting well operations in accordance with claim 29 wherein adjusting the means for restraining the offshore drilling vessel with respect to the compliant platform comprises adjusting a plurality of guylines between the semisubmersible vessel and the compliant platform.

31. A method for conducting well operations in accordance with claim 29 wherein adjusting the means for restraining the offshore drilling vessel with respect to the compliant platform comprises shifting the docking of the semisubmersible vessel to the compliant platform.

32. A method for conducting well operations in accordance with claim 28 wherein sequentially positioning the derrick further comprises skidding the derrick on skid beams.

33. A method for conducting offshore well operations, comprising:

positioning a derrick on an offshore drilling vessel in substantially vertical alignment with both a surface well bay presented by a compliant platform and a well pattern on the ocean floor;

temporarily restraining the offshore drilling vessel with respect to the compliant platform; and conducting well operations from the offshore drilling vessel through a riser while the offshore drilling vessel is restrained with respect to the compliant platform.

34. A method for conducting well operations in accordance with claim 33 wherein conducting well operations comprises completing a predrilled well through a production riser.

35. A method for conducting well operations in accordance with claim 33 wherein conducting well operations comprises conducting primary drilling of a new well.

36. A method for conducting well operations in accordance with claim 33 wherein conducting well operations comprises a secondary, infill drilling of a new well.

37. A method for conducting well operations in accordance with claim 33 wherein conducting well operations comprises conducting workover operations of an existing well.

38. A method for conducting well operations, comprising:

positioning a non-dedicated auxiliary offshore drilling vessel in alignment with a selected well site of a well pattern at a base of a compliant platform;

temporarily restraining the offshore drilling vessel with respect to the compliant platform which is maintained in its normal position in which a surface well bay is presented substantially over the well pattern;

conducting well operations through a riser using facilities on the offshore drilling vessel while the offshore drilling vessel is temporarily restrained with respect to the compliant platform; and disengaging the offshore drilling vessel from restrainment with regard to the compliant platform.

39. A method for conducting well operations in support of a compliant platform, comprising:

positioning a derrick supported on an offshore drilling vessel substantially over a laterally accessible well bay presented by the compliant platform in substantially vertical alignment with a well pattern on the ocean floor;

restraining the offshore drilling vessel with respect to the compliant platform; and conducting well operations from the offshore drilling vessel through a substantially vertical drilling riser.

40. A method for conducting well operations in support of a compliant platform in accordance with claim 39 wherein positioning the derrick of the offshore drilling vessel substantially over the well bay of a compliant platform comprises placing a central well bay semisubmersible vessel over a monopod configuration compliant platform.

41. A method for conducting well operations in accordance with claim 39 wherein positioning the derrick of the offshore drilling vessel further comprises extending the drilling derrick from the offshore drilling vessel on a cantilevered deck.

42. A method for conducting well operations in accordance with claim 41 wherein restraining the offshore drilling vessel with respect to the compliant platform further comprises docking a semisubmersible vessel to a tension leg well jacket.

43. A method for conducting offshore well operations, comprising:

positioning a derrick supported on an offshore drilling vessel in substantially vertical alignment with both a laterally accessible well bay presented by a compliant platform and a well pattern on the ocean floor;

restraining the offshore drilling vessel with respect to the compliant platform; and conducting well operations from the offshore drilling vessel through a riser.

44. A method for conducting well operations, comprising:

positioning an offshore drilling vessel over a selected well site of a well pattern adjacent a compliant platform;

restraining the offshore drilling vessel with respect to the compliant platform which is maintained in its normal position substantially over a well pattern; and conducting well operations through a substantially vertical riser suspended through a laterally accessible surface well bay presented by the compliant platform using facilities on the offshore drilling vessel.

* * * * *